US012753469B2

(12) United States Patent
Chandrasekaran et al.

(10) Patent No.: US 12,753,469 B2
(45) Date of Patent: Oct. 6, 2026

(54) METAL MATRIX COMPOSITES FOR DRILL BITS

(71) Applicant: Kennametal Inc., Latrobe, PA (US)

(72) Inventors: Senthilkumar Chandrasekaran, Bentonville, AR (US); Travis Earl Puzz, Fayetteville, AR (US)

(73) Assignee: KENNAMETAL INC., Latrobe, PA (US)

( * ) Notice: Subject to any disclaimer, the term of this patent is extended or adjusted under 35 U.S.C. 154(b) by 0 days.

(21) Appl. No.: 17/900,632

(22) Filed: Aug. 31, 2022

(65) Prior Publication Data

US 2024/0068077 A1 Feb. 29, 2024

(51) Int. Cl.

| | |
|---|---|
| ***C22C 32/00*** | (2006.01) |
| ***C22C 1/04*** | (2023.01) |
| ***C22C 27/04*** | (2006.01) |
| ***C22C 29/02*** | (2006.01) |
| ***C22C 29/08*** | (2006.01) |

(52) U.S. Cl.

CPC ..... *C22C 32/0052* (2013.01); *C22C 1/0475* (2013.01); *C22C 27/04* (2013.01); *C22C 29/02* (2013.01); *C22C 29/08* (2013.01); *B22F 2303/35* (2013.01)

(58) Field of Classification Search

CPC ..... C22C 32/0052

See application file for complete search history.

(56) References Cited

U.S. PATENT DOCUMENTS

| | | | | |
|---|---|---|---|---|
| 6,287,360 | B1 | 9/2001 | Kembaiyan et al. | |
| 6,682,580 | B2 * | 1/2004 | Findeisen | B22F 1/065 428/545 |
| 8,016,057 | B2 | 9/2011 | Deng | |
| 8,486,541 | B2 * | 7/2013 | Brent | B22F 3/1035 428/614 |
| 9,056,799 | B2 | 6/2015 | Deng et al. | |
| 10,208,366 | B2 | 2/2019 | Olsen et al. | |
| 10,641,045 | B2 | 5/2020 | Cook, III et al. | |
| 10,760,343 | B2 | 9/2020 | Wang et al. | |
| 2006/0207803 | A1 | 9/2006 | Overstreet | |
| 2007/0240910 | A1 | 10/2007 | Kembaiyan et al. | |
| 2013/0092450 | A1 | 4/2013 | Sreshta | |
| 2019/0032173 | A1 | 1/2019 | Sherman et al. | |
| 2019/0071931 | A1 | 3/2019 | Wang et al. | |
| 2020/0384580 | A1 | 12/2020 | Zheng et al. | |

FOREIGN PATENT DOCUMENTS

| | | | |
|---|---|---|---|
| EP | 2570583 | A2 | 3/2013 |
| WO | 2015066418 | A1 | 5/2015 |
| WO | 2016153733 | A1 | 9/2016 |
| WO | 2017052504 | A1 | 3/2017 |

OTHER PUBLICATIONS

International Search Report dated Nov. 28, 2023 from corresponding International Patent Application No. PCT/US2023/072308.

* cited by examiner

*Primary Examiner* — Christopher S Kessler
(74) *Attorney, Agent, or Firm* — Christopher J. Owens

(57) ABSTRACT

Metal matrix composite particle mixtures are disclosed comprising (a) primary tungsten metal particles; (b) metal carbide particles; (c) substantially spherical fused carbide particles; and (d) a binder. The present invention also provides a metal matrix composite comprising metal matrix composite particle mixtures disclosed herein and binders.

25 Claims, 6 Drawing Sheets

METAL MATRIX COMPOSITES FOR DRILL BITS

FIELD OF THE INVENTION

The present invention relates to metal matrix composites used in earth engaging drill bits.

BACKGROUND INFORMATION

Earth engaging drill bits having bit bodies or portions thereof comprising a metal matrix composite (MMC) may be used for mining and drilling, such as for the retrieval of minerals and hydrocarbon resources. For example, a drill bit may be used in the oil and gas drilling industries. A bit body typically comprises one or more cutting elements, such as polycrystalline diamond cutting inserts, embedded in or otherwise carried by the MMC. The bit bodies are typically formed by positioning the cutting elements within a mold, filling the mold with a matrix powder mixture, and then infiltrating the matrix powder mixture with a binder to form the MMC. MMCs typically comprise a ceramic component, which can make the MMCs brittle and vulnerable to cracking. This cracking can lead to failure of the drill bit, requiring either repair or replacement. It would be desirable for a drill bit comprising an MMC to be stronger and more reliable.

SUMMARY OF THE INVENTION

The present invention provides a metal matrix composite for use in an earth engaging drill bit. The metal matrix composite comprises a metal matrix composite particle mixture comprising primary metal particles, metal carbide particles, substantially spherical fused carbide particles, and a binder.

The present invention also provides a metal matrix composite particle mixture for use in a drill bit. The metal matrix composite particle mixture comprises a mixture of primary metal particles, metal carbide particles, and substantially spherical fused carbide particles.

The present invention further provides a metal matrix composite for use in a drill bit. The metal matrix composite comprises a metal matrix composite particle mixture comprising primary metal particles comprising tungsten in an amount of 30 weight percent to 50 weight percent, wherein the primary metal particles have an average particle size of less than 20 microns, metal carbide particles in an amount of 30 weight percent to 50 weight percent, wherein the metal carbide particles have an average particle size of 20 microns to 45 microns, substantially spherical fused carbide particles in an amount of 10 weight percent to 20 weight percent, wherein the substantially spherical fused carbide particles have an average particle size of 150 microns to 400 microns, and secondary metal particles comprising nickel in an amount of 2 weight percent to 8 weight percent, wherein the secondary metal particles have an average particle size of 3 microns to 7 microns, and a metal binder.

DETAILED DESCRIPTION

Figure 1:
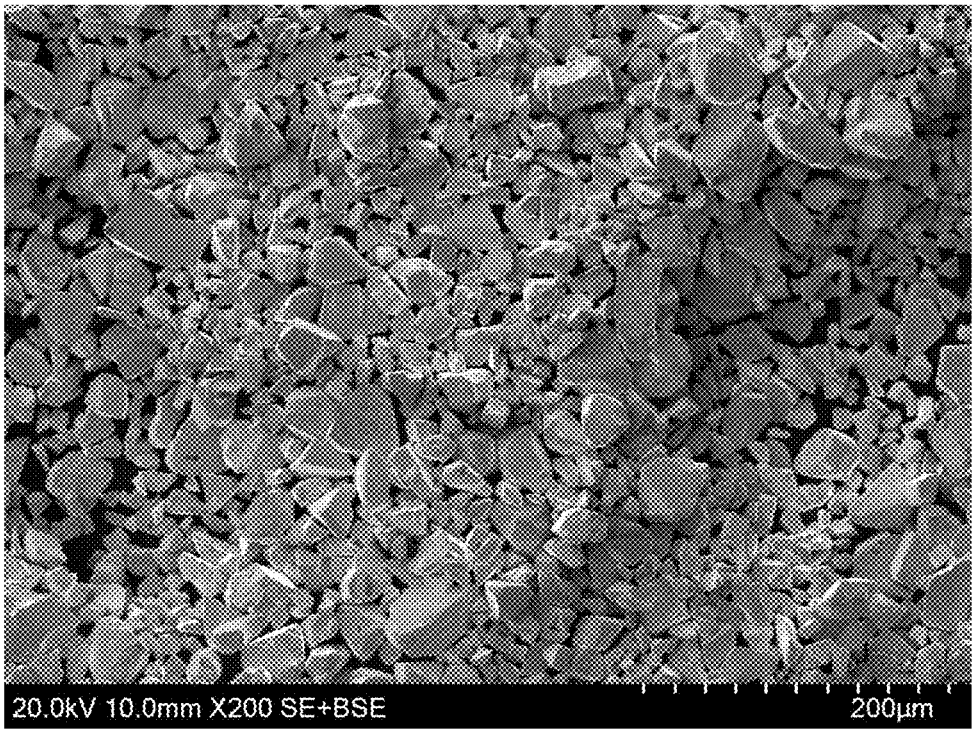
FIG. 1 is a micrograph image of macrocrystalline tungsten carbide powders that may be used to produce a metal matrix composite of the present invention, at a magnification of 200×.

The present disclosure is directed to a metal matrix composite for use in a drill bit. The metal matrix composite comprises a metal matrix composite particle mixture comprising (a) primary metal particles; (b) metal carbide particles; and (c) substantially spherical fused carbide particles.

The present disclosure is also directed to a metal matrix composite particle mixture for use in a drill bit. The metal matrix composite particle mixture comprises a mixture of (a) primary metal particles; (b) metal carbide particles; (c) substantially spherical fused carbide particles; and a binder.

As stated above, the metal matrix composite particle mixture may comprise primary metal particles. The primary metal particles may comprise elemental tungsten, tungsten alloys, or combinations thereof. Examples of tungsten alloys include, but are not limited to, tungsten alloys comprising alloying additions such as copper, nickel, iron, cobalt, molybdenum, manganese, or the like.

The primary metal particles may be present in the metal matrix composite particle mixture in an amount of at least 15 weight percent, such as at least 20 weight percent, such as at least 30 weight percent, such as at least 40 weight percent, based on total weight of the metal matrix composite particle mixture. The primary metal particles may be present in the metal matrix composite particle mixture in an amount of no more than 70 weight percent, such as no more than 60 weight percent, such as no more than 50 weight percent, based on total weight of the metal matrix composite particle mixture. The primary metal particles may be present in the metal matrix composite powder mixture in an amount of 15 weight percent to 70 weight percent, such as 20 weight percent to 60 weight percent, such as 30 weight percent to 50 weight percent, such as 40 weight percent to 50 weight percent, based on total weight of the metal matrix composite particle mixture. In accordance with the present invention applicant has surprisingly found that increasing tungsten content does not diminish erosion resistance and the toughness of the metal matrix composite is maximized.

The primary metal particles may have an average particle size of at least 1 microns, such as at least 2.5 microns, such as at least 2.8 microns, such as at least 14 microns, as measured by ASTM B330. The primary metal particles may have an average particle size of no more than 177 microns, such as no more than 44 microns, such as no more than 20 microns, such as no more than 17 microns, such as no more than 4.8 microns, as measured by ASTM B330. The primary metal particles may have an average particle size of 1 microns to 177 microns, such as 2.5 microns to 44 microns, such as 2.8 microns to 17 microns, such as 2.8 microns to 4.8 microns, such as 14 microns to 17 microns, such as 1 microns to 20 microns, such as 2.5 microns to 20 microns, such as 14 microns to 20 microns, as measured by ASTM B330.

The primary metal particles may have a thermal conductivity of at least 50 W/mK, such as at least 100 W/mK, such as at least 150 W/mK. The primary metal particles may have a thermal conductivity of 200 W/mK, or higher. For example, when the primary metal particles comprise elemental tungsten, the primary metal particles have a thermal conductivity of about 173 W/mK.

The primary metal particles have a relatively higher thermal conductivity relative to the metal carbide particles and the fused carbide particles. The metal carbide particles have a relatively higher thermal conductivity relative to the fused carbide particles. The primary metal particles increase the thermal conductivity of a metal matrix composite comprising one of the metal matrix composite particle mixtures disclosed herein.

Optionally, the metal matrix composite particle mixture may comprise secondary metal particles. In non-limiting examples, the secondary metal particles may comprise nickel, iron, molybdenum, or combinations thereof. In examples, the metal matrix composite particle mixture may further comprise secondary metal particles comprising nickel powder.

The secondary metal particles, if present at all, may be present in the metal matrix composite particle mixture in an amount of at least 0.1 weight percent, such as at least 0.5 weight percent, such as at least 1 weight percent, such as at least 2 weight percent, based on total weight of the metal matrix composite particle mixture. The secondary metal particles may be present in the metal matrix composite particle mixture in an amount of no more than 20 weight percent, such as no more than 15 weight percent, such as no more than 10 weight percent, such as no more than 8 weight percent, based on total weight of the metal matrix composite particle mixture. The secondary metal particles may be present in the metal matrix composite particle mixture in an amount of 0 weight percent to 20 weight percent, such as 0 weight percent to 15 weight percent, such as 0 weight percent to 10 weight percent, such as 0.5 weight percent to 20 weight percent, such as 1 weight percent to 10 weight percent, such as 2 weight percent to 8 weight percent, based on total weight of the metal matrix composite particle mixture.

The secondary metal particles may have an average particle size of at least 1 microns, such as at least 2 microns, such as at least 3 microns, as measured by ASTM B330. The secondary metal particles may have an average particle size of no more than 25 microns, such as no more than 15 microns, such as no more than 10 microns, such as no more than 7 microns, as measured by ASTM B330. The secondary metal particles may have an average particle size of 1 microns to 25 microns, such as 2 microns to 15 microns, such as 3 microns to 10 microns, such as 3 microns to 7 microns, as measured by ASTM B330.

The metal matrix composite particle mixture may further comprise metal carbide particles. The metal carbide particles may comprise macrocrystalline tungsten carbide, conventionally carburized tungsten carbide, cemented tungsten carbide, or combinations thereof.

The metal carbide particles may be present in the metal matrix composite particle mixture in an amount of at least 20 weight percent, such as at least 30 weight percent, such as at least 35 weight percent, based on total weight of the metal matrix composite particle mixture. The metal carbide particles may be present in the metal matrix composite particle mixture in an amount of no more than 75 weight percent, such as no more than 70 weight percent, such as no more than 50 weight percent, based on total weight of the metal matrix composite particle mixture. The metal carbide particles may be present in the metal matrix composite particle mixture in an amount of 20 weight percent to 75 weight percent, such as 30 weight percent to 70 weight percent, such as 30 weight percent to 50 weight percent, such as 35 weight percent to 50 weight percent, based on total weight of the metal matrix composite powder mixture.

The metal carbide particles have an average particle size of at least 0.5 microns as measured by ASTM B822, such as at least 10 microns, such as at least 15 microns, such as at least 20 microns. The metal carbide particles have an average particle size of no more than 74 microns, such as no more than 50 microns, such as no more than 45 microns, such as no more than 30 microns. The metal carbide particles have an average particle size of 0.5 microns to 74 microns, such as 10 microns to 50 microns, such as 15 microns to 30 microns, such as 20 microns to 45 microns. The metal carbide particles may have a faceted shape.

The metal matrix composite particle mixture may also comprise substantially spherical fused carbide particles. The fused carbide particles may comprise cast tungsten carbide, such as spherical cast fused tungsten carbide, crushed cast fused tungsten carbide, or combinations thereof.

The fused carbide particles may be present in the metal matrix composite particle mixture of at least 5 weight percent, such as at least 7 weight percent, such as at least 10 weight percent, based on total weight of the metal matrix composite particle mixture. The fused carbide particles may be present in the metal matrix composite particle mixture in an amount of no more than 30 weight percent, such as no more than 25 weight percent, such as no more than 20 weight percent based on total weight of the metal matrix composite particle mixture. The fused carbide particles may be present in the metal matrix composite particle mixture in an amount of 5 weight percent to 30 weight percent, such as 7 weight percent to 25 weight percent, such as 10 weight percent to 20 weight percent, based on total weight of the metal matrix composite particle mixture.

The fused carbide particles have an average particle size of at least 75 microns as measured by ASTM B822, such as at least 100 microns, such as at least 150 microns. The fused carbide particles have an average particle size of no more than 400 microns, such as no more than 300 microns, such as no more than 250 microns. The fused carbide particles have an average particle size of 75 microns to 400 microns, such as 100 microns to 300 microns, such as 150 microns to 250 microns, such as 150 microns to 400 microns.

As noted previously, the fused carbide particles are substantially spherical in shape. As used herein, "spherical" means that the particles are generally sphere-shaped, having convexly curved outer surfaces with substantially no flat or concave surface areas.

The primary metal particles have a relatively high transverse rupture strength relative to the metal carbide particles and the fused carbide particles. The metal carbide particles have a relatively high transverse rupture strength relative to the fused carbide particles. The primary metal particles increase transverse rupture strength in a metal matrix composite comprising one of the metal matrix composite particle mixtures disclosed herein.

The fused carbide particles have a relatively greater erosion resistance relative to the primary metal particles and the metal carbide particles. The fused carbide particles increase erosion resistance of a metal matrix composite comprising one of the metal matrix composite particle mixtures disclosed herein.

The fused carbide particles have a hardness that is relatively higher relative to the primary metal particles and the metal carbide particles. The metal carbide particles have a relatively higher hardness relative to the primary metal particles. The primary metal particles have a hardness that is relatively lower relative to the metal carbide particles and the fused carbide particles.

The primary metal particles have a fracture toughness that is relatively higher relative to the fused carbide particles and the metal carbide particles. The primary metal particles increase the fracture toughness of a metal matrix composite comprising one of the metal matrix composite particle mixtures disclosed herein.

As stated above, the present invention is also directed to a metal matrix composite comprising one of the metal matrix composite particle mixtures disclosed herein; and a metal binder.

The metal matrix composite may comprise any of the metal matrix composite particle mixtures disclosed herein above. The metal matrix composite may be made by any conventional technique, such as, for example, pressing and sintering and additive manufacturing.

The metal matrix composite may further comprise a metal binder. The metal binder infiltrates the metal matrix composite particle mixture and metallurgically bonds to each of the particles of the mixture. The metal binder fills the interstices between the particles and bonds the particles of the metal matrix composite particle mixture together when melted in the infiltration process.

The metal binder may comprise metals such as copper, manganese, nickel, zinc, tin and the like. For example, the metal binder may comprise a combination of copper, manganese, nickel, and zinc.

The metal matrix composite particle mixture and the metal binder may be present in the metal matrix composite in a particle to binder weight ratio of at least 0.3:1, such as at least 0.5:1, such as at least 0.8:1. The particle to binder weight ratio may be no more than 5:1, such as no more than 3:1, such as no more than 2:1. The particle to binder weight ratio may be from 0.5:1 to 2:1, such as 0.3:1 to 5:1, such as 0.8:1 to 3:1.

The metal matrix composite may comprise (a) a metal matrix composite particle mixture comprising (i) primary metal particles comprising tungsten in an amount of 30 weight percent to 50 weight percent, wherein the primary metal particles have an average particle size of less than 20 microns; (ii) metal carbide particles in an amount of 30 weight percent to 50 weight percent, wherein the metal carbide particles have an average particle size of 20 microns to 45 microns; (iii) substantially spherical fused carbide particles in an amount of 10 weight percent to 20 weight percent, wherein the substantially spherical fused carbide particles have an average particle size of 150 microns to 400 microns; and (iv) secondary metal particles comprising nickel in an amount of 2 weight percent to 8 weight percent, wherein the secondary metal particles have an average particle size of 3 microns to 7 microns; and (b) a metal binder.

The metal matrix composite of the present disclosure may have a transverse rupture strength (TRS) of at least 1150 MPa, such as at least 1200 MPa, such as at least 1350 MPa, such as at least 1400 MPa, as measured by the standard ASTM B406.

The metal matrix composite of the present disclosure may have a theoretical thermal shock resistance (TSR) relative to TRS of at least 22,000 W/m, such as at least 24,000 W/m, such as at least 26,000 W/m, such as at least 28,000 W/m. For purposes of this paragraph, the theoretical thermal shock resistance relative to TRS is calculated according to the equation, $TSR=kTRS/E\alpha$, wherein k=thermal conductivity, TRS=transverse rupture strength, E=Modulus of elasticity or Young's modulus, and $\alpha$=coefficient of thermal expansion.

The metal matrix composite of the present disclosure may have a theoretical thermal shock resistance relative to fracture toughness of at least 700 $W/m^{1/2}$, such as at least 750 $W/m^{1/2}$, such as at least 800 $W/m^{1/2}$. For purposes of this paragraph, the theoretical thermal shock resistance relative to fracture toughness is calculated according to the equation $TSR=kK1C/E\alpha$, wherein k=thermal conductivity, K1C=modified E399 fracture toughness, E=modulus of elasticity or Young's modulus, and $\alpha$=coefficient of thermal expansion.

The metal matrix composite of the present disclosure may have a thermal conductivity of at least 40 W/mK, such as at least 45 W/mK, such as at least 50 W/mK. The thermal conductivity was calculated according to the equation $k=Qd/\Delta\Delta T$, wherein Q=amount of heat transferred, d=distance between the two isothermal planes, A=area of the surface, and $\Delta T$=difference in temperature.

The metal matrix composite of the present disclosure may have a fracture toughness of at least 33 $MPa\cdot m^{1/2}$, such as at least 35 $MPa\cdot m^{1/2}$, such as at least 40 $MPa\cdot m^{1/2}$. The fracture toughness may be measured according to the standard ASTM E399 test, modified as set forth in "Toughness Measurement of Cemented Carbides with Chevron-Notched Three-Point Bend Test", September 2010, Advanced Engineering Materials 12(9):948-952 by Xin Deng, Jon Bitler, and K. K. Chawla, and B. Patterson.

The metal matrix composite may have a transverse rupture strength of at least 1311 MPa, such as at least 1380 MPa, such as at least 1518 MPa. The transverse rupture strength was measured according to the standard ASTM B406.

The metal matrix composite of the present disclosure may have an erosion resistance of no more than 15 $mm^3/kg$, such as no more than 12 $mm^3/kg$, such as no more than 11 $mm^3/kg$, such as no more than 10 $mm^3/kg$. The erosion resistance may be measured according to a modified ASTM G 76-04 test using the following standard procedure. Test coins (1.5" diameter x ¼" to ⅜" thick) are prepared by machine smoothing the surface of each test coin. The coin is then dried and weighed to 0.001 grams accuracy. A high pressure tester is prepared using AFS Testing Sand ($SiO_2$) 50/70 mesh, a high pressure water pump (Hyperson HVC-20 Power Unit Series 222037), a wet sandblaster (Wet Sandblaster Model #30667) with gun handle (Model #30342), and a spray nozzle (Washjet Spray Nozel Model #MEG-SSTC-1504). The start weight of the sand is recorded to 0.05 lb. accuracy. Each test coin is placed into a fixture and secured. Each test coin is sprayed for 30 seconds with water at a pressure of 1000 psi. The coin ending weight and the sand ending weight are recorded. The erosion factor is determined using the equation (coin weight loss/density)/(sand used)=erosion factor ($mm^3$/kg). The test is completed twice for each sample and averaged.

Example 1

Metal matrix composites of the present invention were made as follows. Powders of macrocrystalline tungsten carbide, tungsten, spherical fused carbide, and nickel having average particle sizes as measured in accordance with standard ASTM test procedures as listed in Table 1 were mixed together in the amounts shown in Table 1.

TABLE 1

| | Macrocrystalline Tungsten Carbide (ASTM B822) | | Tungsten (ASTM B330) | | Spherical Fused Carbide (ASTM B822) | | Nickel (ASTM B330) | |
|---|---|---|---|---|---|---|---|---|
| | Wt. % | Particle Size (μm) | Wt. % | Particle Size (μm) | Wt. % | Particle Size (μm) | Wt. % | Particle Size (μm) |
| Sample 1 | 41.675 | 20 | 41.675 | 3.8 | 14.70 | 215 | 1.95 | 4 |
| Sample 2 | 39.35 | 20 | 39.35 | 3.8 | 13.89 | 215 | 7.41 | 4 |

Figure 2:
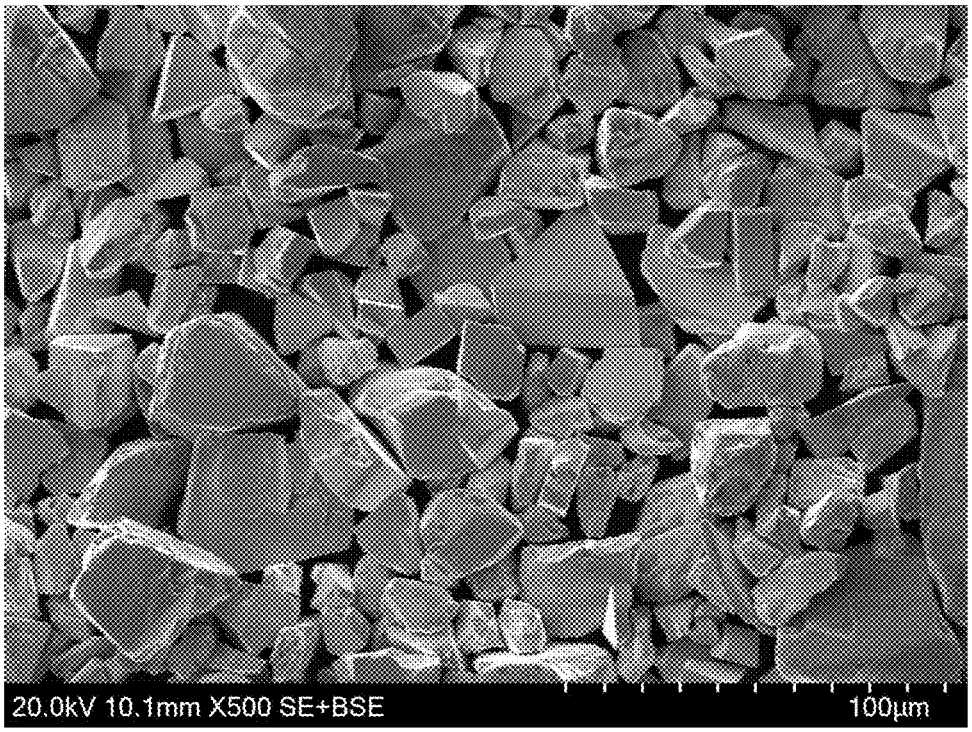
FIG. 2 is a micrograph image of macrocrystalline tungsten carbide powders that may be used to produce a metal matrix composite of the present invention, at a magnification of 500×.
Figure 3:
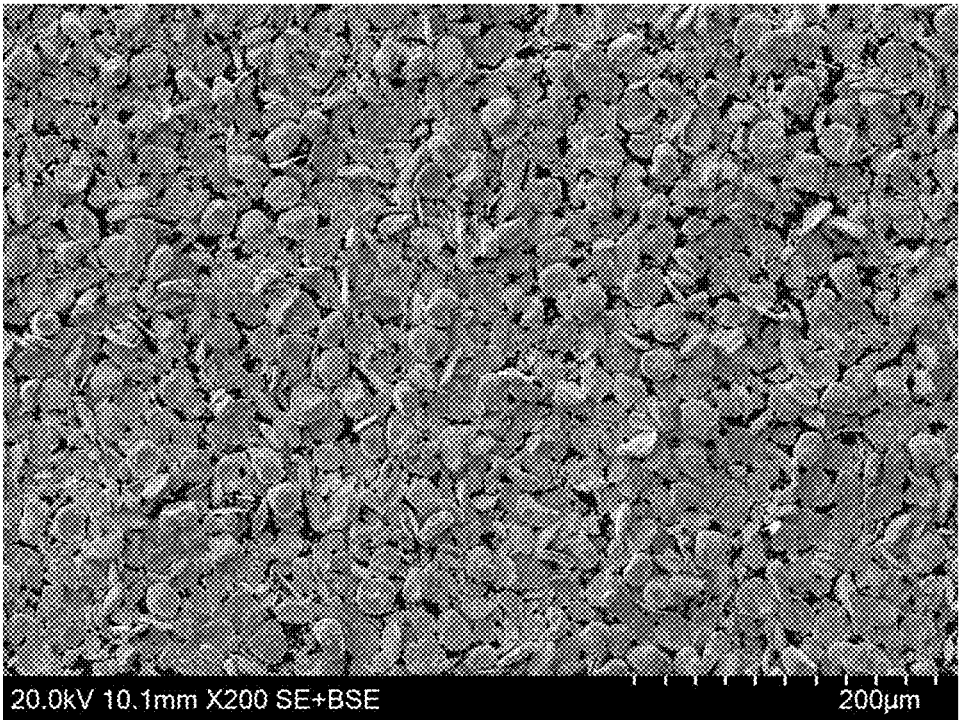
FIG. 3 is a micrograph image of tungsten powders that may be used to produce a metal matrix composite of the present invention, at a magnification of 200×.
Figure 4:
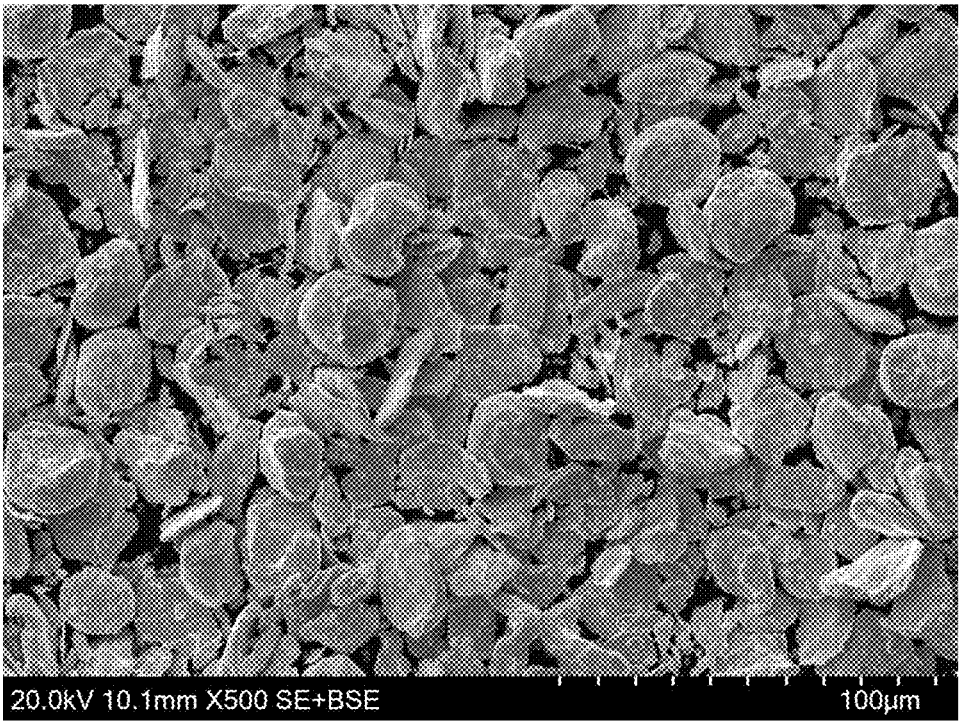
FIG. 4 is a micrograph image of tungsten powders that may be used to produce a metal matrix composite of the present invention, at a magnification of 500×.
Figure 5:
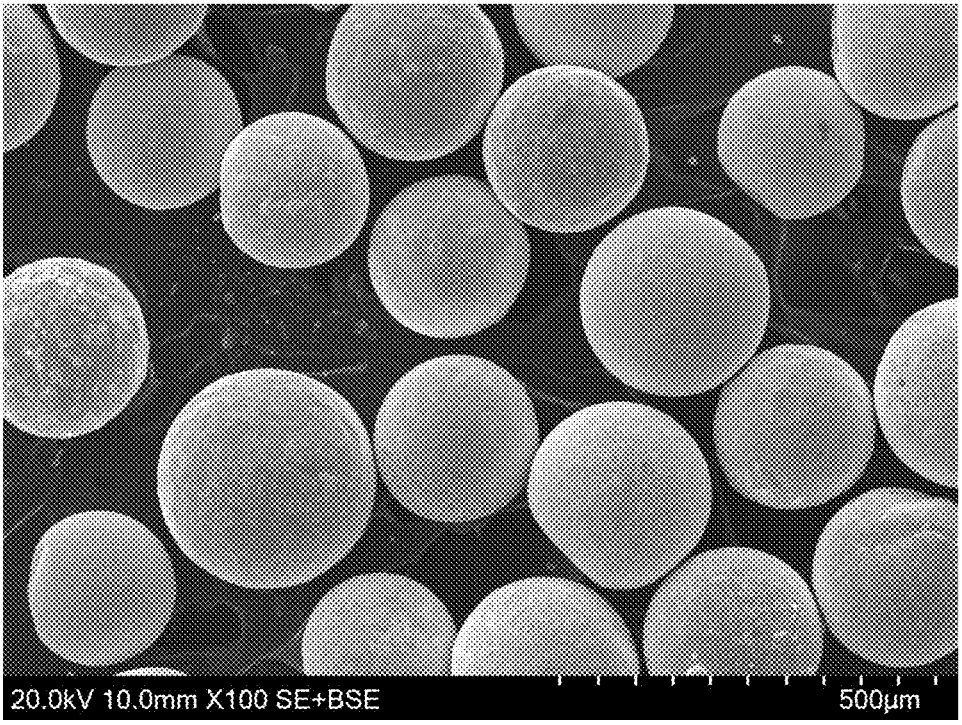
FIG. 5 is a micrograph image of spherical fused carbide particle powders that may be used to produce a metal matrix composite of the present invention, at a magnification of 100×.
Figure 6:
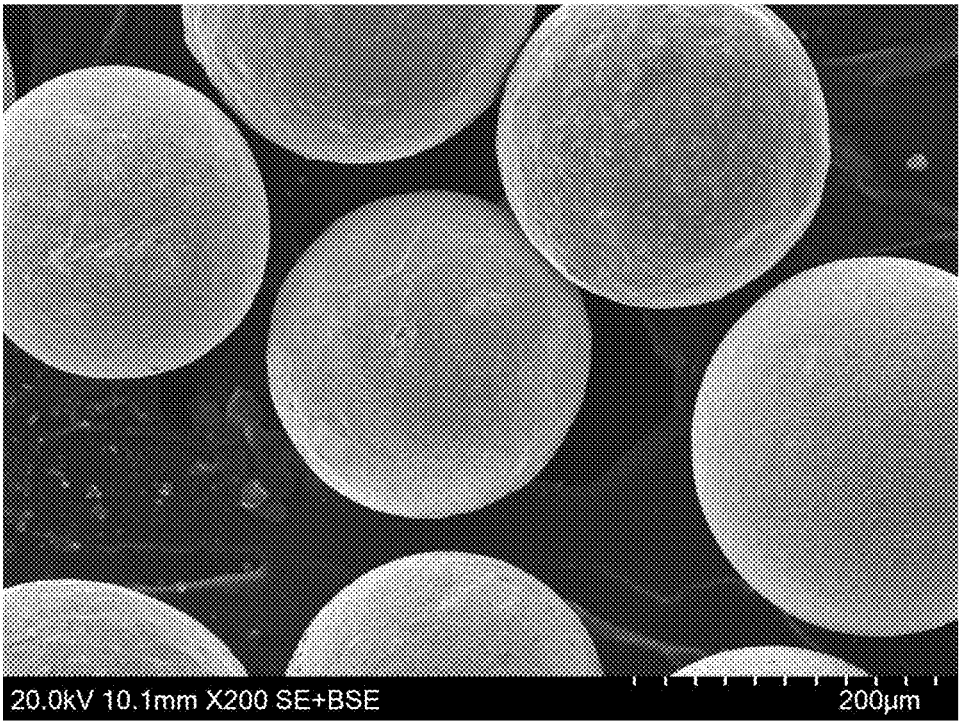
FIG. 6 is a micrograph image of spherical fused carbide particle powders that may be used to produce a metal matrix composite of the present invention, at a magnification of 200×.

Micrograph images of the macrocrystalline tungsten carbide powders at magnifications of 200× and 500× are shown in FIGS. 1 and 2, respectively. Micrograph images of the tungsten powders at magnifications of 200× and 500× are shown in FIGS. 3 and 4, respectively. Micrograph images of the spherical fused carbide particles at magnifications of 100× and 200× are shown in FIGS. 5 and 6, respectively.

Figure 7:
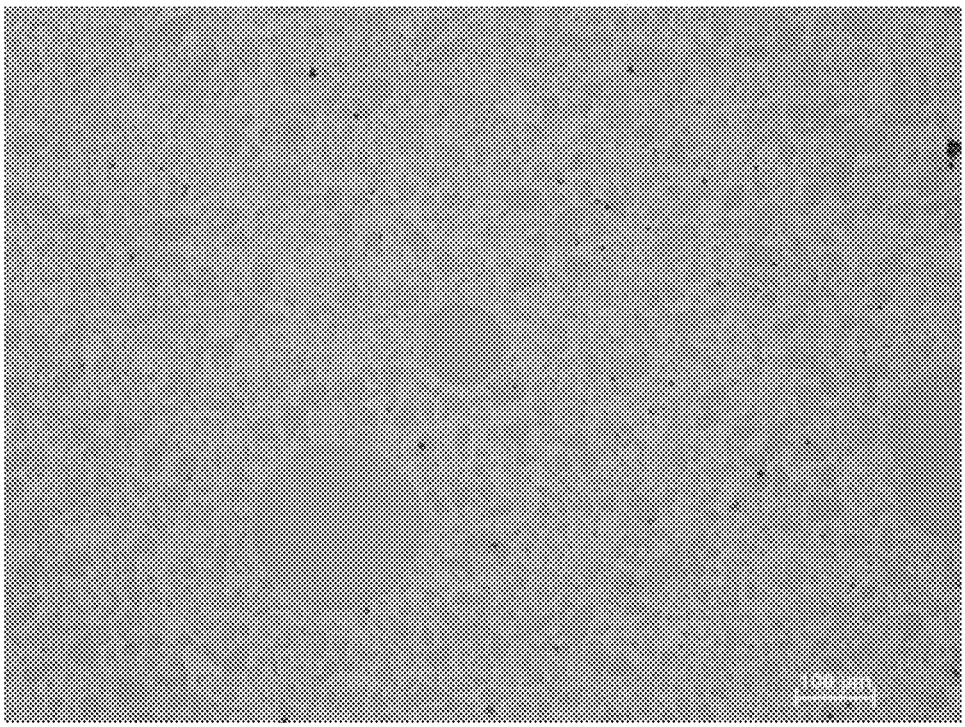
FIG. 7 is a micrograph of Sample 1 of the MMC of Example 1 at a magnification of 100×.

The powders listed in Table 1 were mixed in the amounts shown, and the particle mixture was infused with a molten binder metal by known infiltration methods with 50 weight percent of the metal binder, based on total weight of the metal matrix composite. The metal binder included a combination of copper, manganese, nickel, and zinc. A micrograph image of Sample No. 1 is shown in FIG. 7, at a magnification of 100×. The substantially spherical fused carbide particles are visible in the micrograph image. As can be seen, the fused carbide particles are generally spherical with convexly curved outer surfaces having substantially no flat or concave surface areas and substantially no faceted or angular edges.

Example 2

Figure 8:
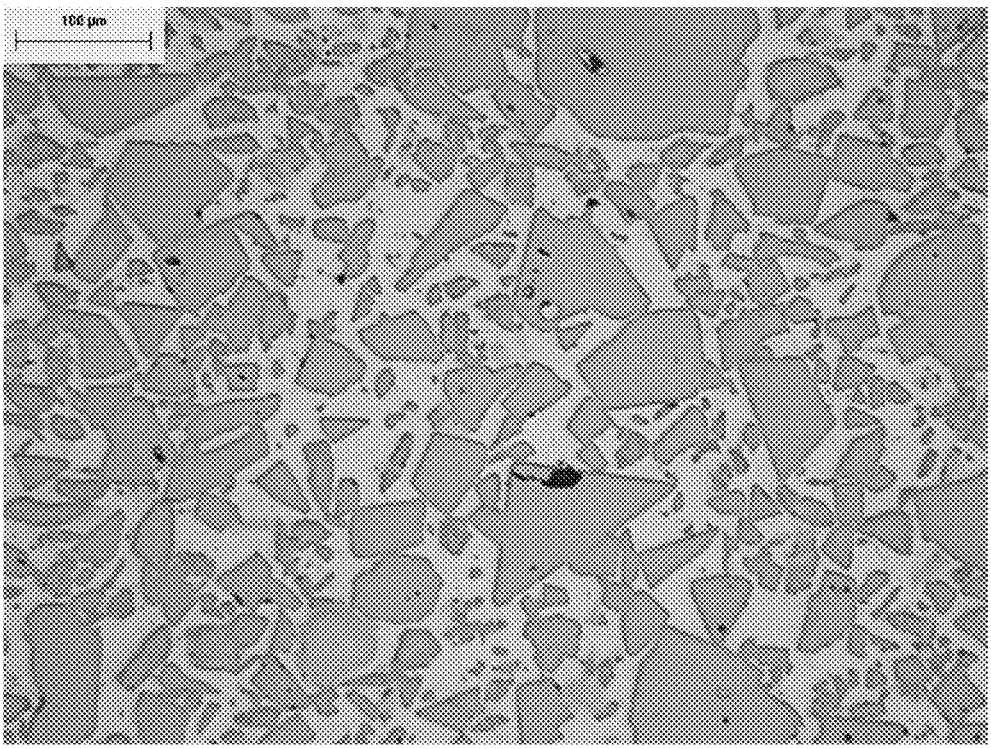
FIG. 8 is a micrograph of Comparative Sample 1 of the MMC of Example 2 at a magnification of 100×.
Figure 9:
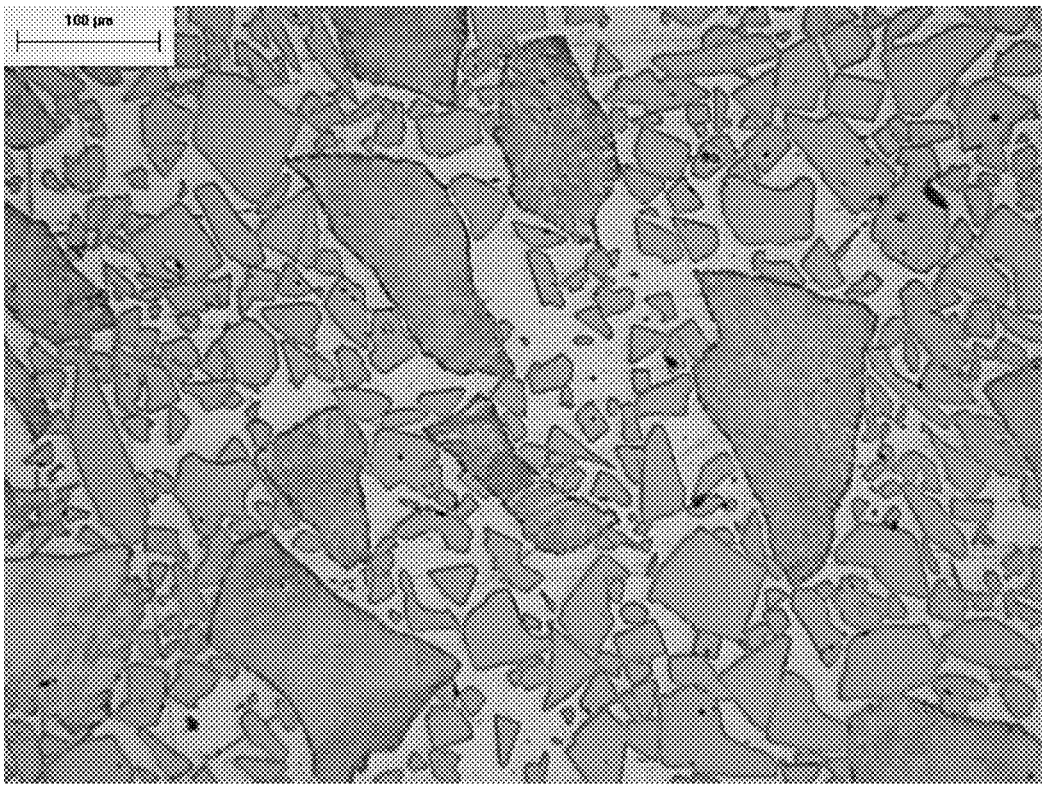
FIG. 9 is a micrograph of Comparative Sample 2 of the MMC of Example 2 at a magnification of 100×.

Micrograph images of Comparative Sample Nos. 1 and 2 are shown in FIGS. 8 and 9, respectively, at magnifications of 100×.

TABLE 2

| | Macrocrystalline Tungsten Carbide (ASTM B822) | | Fused/Cast Tungsten Carbide (ASTM B822) | | Nickel (ASTM B330) | |
|---|---|---|---|---|---|---|
| | Wt. % | Particle Size (μm) | Wt. % | Particle Size (μm) | Wt. % | Particle Size (μm) |
| Comparative Sample 1 | 81 | 74 | 14 | 13 | 2 | 4 |
| Comparative Sample 2 | 67 | 30 | 31 | 125 | 2 | 4 |

Sample Nos. 1 and 2 and Comparative Sample Nos. C1 and C2 were subjected to transverse rupture strength (TRS), toughness, erosion resistance, thermal conductivity, and hardness testing. Thermal shock resistance (TSR) was calculated relative to TRS and TSR relative to fracture toughness. The test results are shown in Table 3 below.

TABLE 3

| Sample | Transverse Rupture Strength (MPa) | Erosion Factor ($mm^3$/kg) | TSR Relative to TRS (W/m) | TSR Relative to Fracture Toughness ($W/m^{1/2}$) | Fracture Toughness (MPa · $m^{1/2}$) |
|---|---|---|---|---|---|
| 1 | 1414 | 11 | 28,000 | 845 | 42 |
| 2 | 1359 | 10 | 26,000 | 800 | 35 |
| C1 | 897 | 17 | 21,000 | 656 | 32 |
| C2 | 1104 | 9 | 17,000 | 453 | 32 |

TRS was measured in accordance with the standard ASTM B406 test. Fracture toughness was measured as described above. Erosion resistance was measured in accordance with the erosion test described above. Thermal shock resistance relative to TRS was calculated according to the equation TSR=kTRS/Eα, wherein k=thermal conductivity, TRS=transverse rupture strength, E=Modulus of elasticity or Young's modulus, and α=coefficient of thermal expansion. Thermal shock resistance relative to fracture toughness was calculated according to the equation TSR=kK1C/Eα, wherein k=thermal conductivity, K1C=modified E399 fracture toughness, E=modulus of elasticity or Young's modulus, and α=coefficient of thermal expansion.

Figure 10:
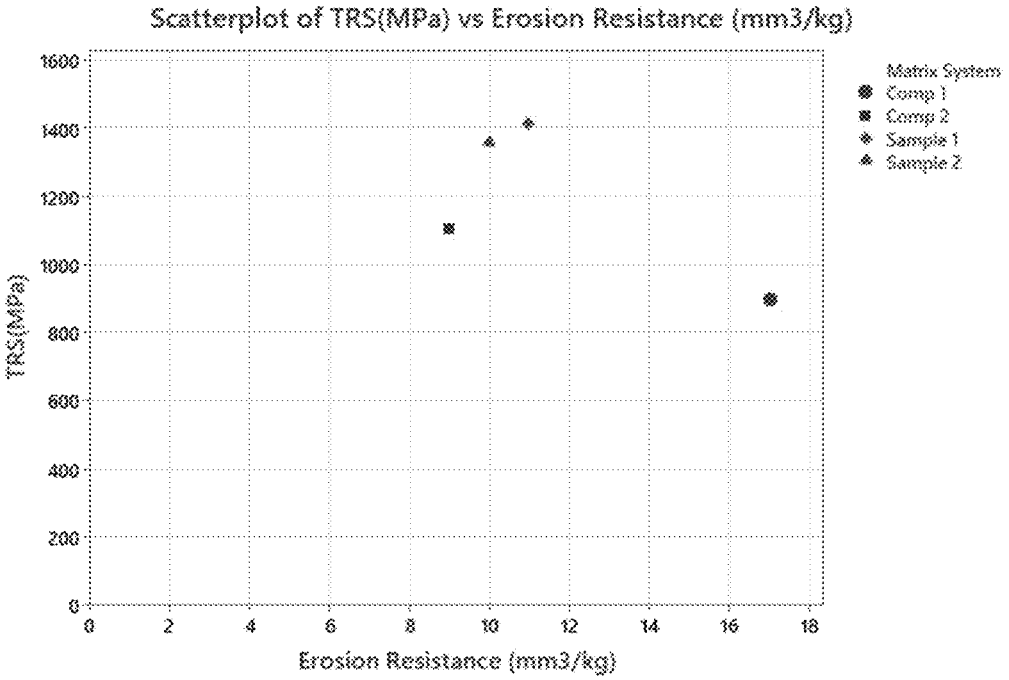
FIG. 10 is a graph of transverse rupture strength (TRS) vs. erosion resistance for MMC samples of the present invention and comparative MMC samples.
Figure 11:
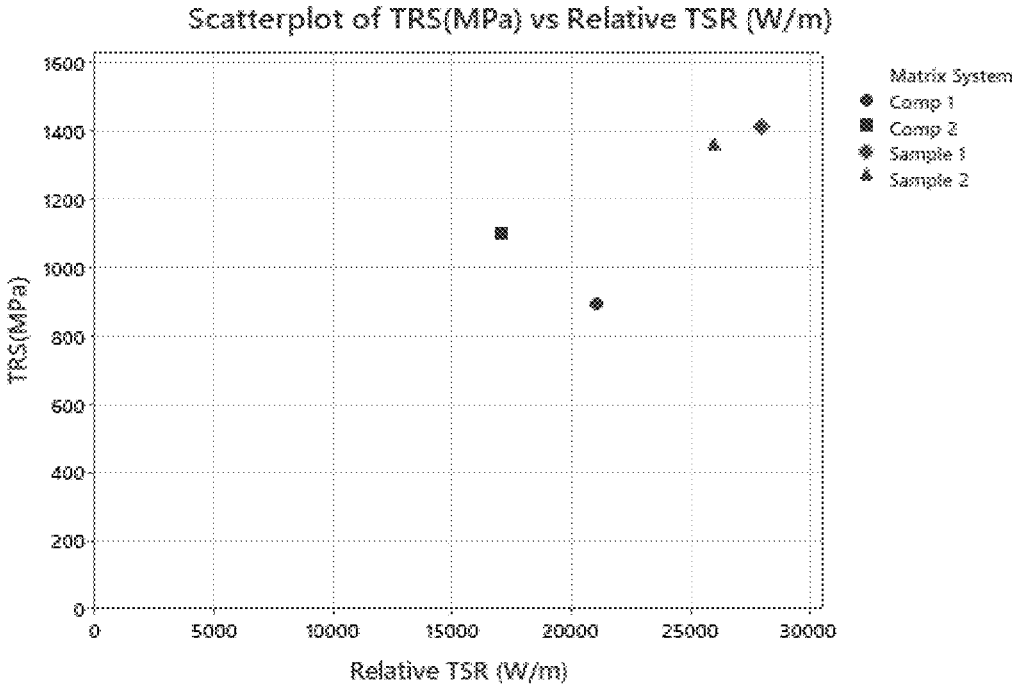
FIG. 11 is a graph of TRS vs. thermal shock resistance (TSR) relative to TRS in units of W/m for MMC samples of the present invention and comparative MMC samples.
Figure 12:
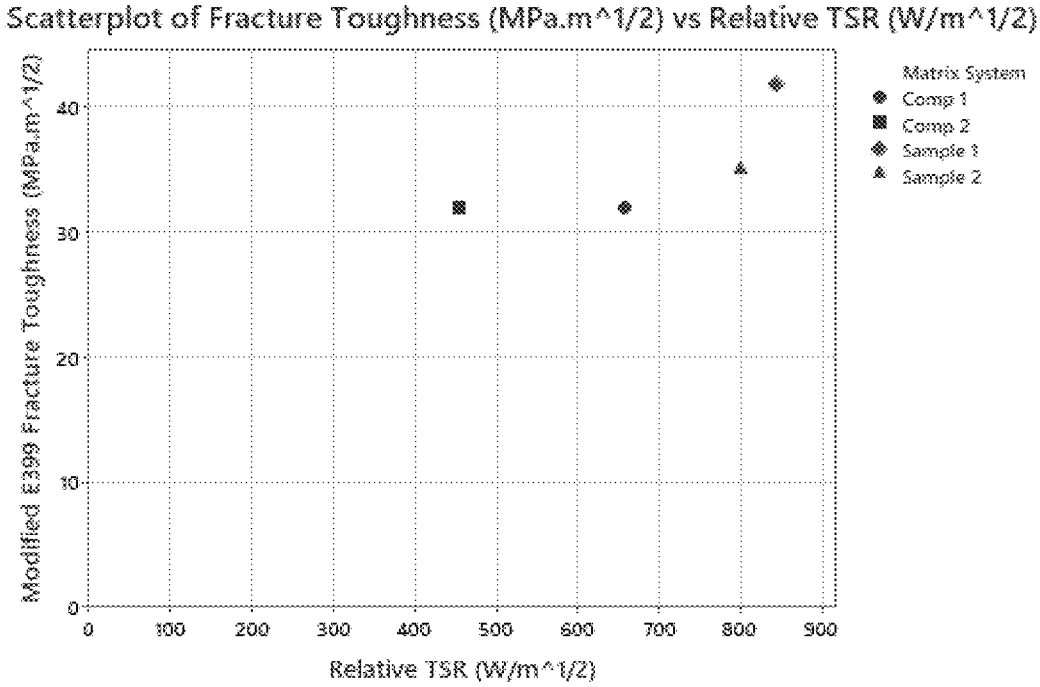
FIG. 12 is a graph of fracture toughness vs. TSR relative to fracture toughness in units of $W/m^{1/2}$ for MMC samples of the present invention and comparative MMC samples.

A graph showing a scatterplot of TRS as a function of erosion resistance is provided in FIG. 10. A graph showing a scatterplot of TRS as a function of TSR relative to TRS in units of W/m is provided in FIG. 11. A graph showing a scatterplot of fracture toughness as a function of TSR relative to fracture toughness in units of $W/m^{1/2}$ is shown in FIG. 12.

For purposes of the following detailed description, it is to be understood that the disclosure may assume various alternative variations and step sequences, except where expressly specified to the contrary. Moreover, other than in any operating examples, or where otherwise indicated, all numbers such as those expressing values, amounts, percentages, ranges, subranges, and fractions may be read as if prefaced by the word "about," even if the term does not expressly appear. Accordingly, unless indicated to the contrary, the numerical parameters set forth in the following specification and attached claims are approximations that may vary depending upon the desired properties to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Where a closed or open-ended numerical range is described herein, all numbers, values, amounts, percentages, subranges, and fractions within or encompassed by the numerical range are to be considered as being specifically included in and belonging to the original disclosure of this application as if these numbers, values, amounts, percentages, subranges and fractions had been explicitly written out in their entirety.

Notwithstanding that the numerical ranges and parameters setting forth the broad scope of the disclosure are approximations, the numerical values set forth in the specific examples are recited as precisely as possible. Any numerical value, however, inherently contains certain errors necessarily resulting from the standard deviation found in their respective testing measurements.

As used herein, unless indicated otherwise, a plural term can encompass its singular counterpart and vice versa, unless indicated otherwise. For example, although reference is made herein to "a" binder and "an" erosion resistance, a combination (i.e., a plurality) of these components can be used.

In addition, in this application, the use of "or" means "and/or" unless specifically stated otherwise, even though "and/or" may be explicitly used in certain circumstances.

As used herein, "including," "containing," and like terms are understood in the context of this application to be synonymous with "comprising" and are therefore open-ended and do not exclude the presence of additional undescribed or unrecited elements, materials, ingredients, or method steps. As used herein, "consisting essentially of" is understood in the context of this application to include the specified elements, materials, ingredients, or method steps and those that do not materially affect the basic and novel characteristic(s) of what is being described. As used herein, "consisting of" is understood in the context of this application to exclude the presence of any unspecified element, ingredient, or method step.

As used herein, unless indicated otherwise, the term "substantially free" means that a particular material is not purposefully added to a mixture or composition, respectively, and is only present as an impurity in a trace amount.

Whereas aspects of the disclosure have been described in detail, it will be appreciated by those skilled in the art that various modifications and alternatives to those details could be developed in light of the overall teachings of the disclosure. Accordingly, the particular arrangements disclosed are meant to be illustrative only and not limited as to the scope of the disclosure which is to be given the full breadth of the claims and any and all equivalents thereof

What is claimed is:

1. A metal matrix composite for use in a drill bit, the metal matrix composite comprising:

(a) a metal matrix composite particle mixture comprising:

(i) primary metal particles having an average particle size of 1 micron to 177 microns in an amount of at least 20 weight percent, based on total weight of the metal matrix composite particle mixture;

(ii) metal carbide particles; and (iii) substantially spherical fused carbide particles; and (b) a metal binder, wherein the metal matrix composite has an erosion resistance of no more than 12 $mm^3$/kg and a transverse rupture strength of at least 1150 MPa, and wherein the substantially spherical fused carbide particles have an average particle size greater than an average particle size of the metal carbide particles.

2. The metal matrix composite of claim 1, wherein:

(a) the primary metal particles are present in an amount of no more than 70 weight percent, based on total weight of the metal matrix composite particle mixture;

(b) the metal carbide particles are present in an amount of 20 weight percent to 75 weight percent, based on total weight of the metal matrix composite particle mixture; and (c) the fused carbide particles are present in an amount of 5 weight percent to 30 weight percent, based on total weight of the metal matrix composite particle mixture.

3. The metal matrix composite of claim 1, wherein the primary metal particles comprise elemental tungsten, a tungsten alloy, or a combination thereof.

4. The metal matrix composite of claim 1, wherein the metal carbide particles have an average particle size of 0.5 microns to 74 microns.

5. The metal matrix composite of claim 1, wherein the metal carbide particles comprise macrocrystalline tungsten carbide.

6. The metal matrix composite of claim 1, wherein the metal carbide particles have a faceted shape.

7. The metal matrix composite of claim 1, wherein the fused carbide particles have an average particle size of 75 microns to 400 microns.

8. The metal matrix composite of claim 1, wherein the fused carbide particles comprise cast tungsten carbide.

9. The metal matrix composite of claim 1, wherein the weight ratio of the metal matrix composite particle mixture to the metal binder is 0.3:1 to 5:1.

10. The metal matrix composite of claim 1, wherein the metal binder comprises copper, manganese, nickel, zinc, or a combination thereof.

11. The metal matrix composite of claim 1, wherein the metal matrix composite particle mixture further comprises a secondary metal.

12. The metal matrix composite of claim 11, wherein the secondary metal comprises nickel, molybdenum, iron, or a combination thereof.

13. The metal matrix composite of claim 11, wherein the secondary metal is present in an amount of 0 weight percent to 20 weight percent, based on total weight of the metal matrix composite particle mixture.

14. The metal matrix composite of claim 11, wherein the secondary metal has a particle size of 1 micron to 25 microns.

15. The metal matrix composite of claim 1, wherein:

(a) primary metal particles comprising tungsten, wherein the primary metal particles are present in an amount of 30 weight percent to 50 weight percent, and wherein the primary metal particles have an average particle size of less than 20 microns;

(b) the metal carbide particles are present in an amount of 30 weight percent to 50 weight percent, wherein the metal carbide particles have an average particle size of 20 microns to 45 microns;

(c) the substantially spherical fused carbide particles are present in an amount of 10 weight percent to 20 weight percent, wherein the substantially spherical fused carbide particles have an average particle size of 150 microns to 400 microns; and (d) further comprising secondary metal particles comprising nickel in an amount of 2 weight percent to 8 weight percent, wherein the secondary metal particles have an average particle size of 3 microns to 7 microns.

16. The metal matrix composite of claim 1, wherein the metal matrix composite has a theoretical thermal shock resistance relative to fracture toughness of at least 700 $W/m^{1/2}$, calculated according to the equation TSR=kK1C/Eα, wherein k=thermal conductivity, K1C=modified E399 fracture toughness, E=modulus of elasticity or Young's modulus, and α=coefficient of thermal expansion.

17. The metal matrix composite of claim 1, wherein the metal matrix composite has a theoretical thermal shock resistance relative to transverse rupture strength of at least 22,000 W/m, calculated according to the equation TSR=kTRS/Eα, wherein k=thermal conductivity, TRS=transverse rupture strength, E=Modulus of elasticity or Young's modulus, and α=coefficient of thermal expansion.

18. The metal matrix composite of claim 1, wherein the metal matrix composite has a thermal conductivity of at least 40 W/mK.

19. The metal matrix composite of claim 1, wherein the metal matrix composite has a fracture toughness of at least 33 $MPa \cdot m^{1/2}$.

20. The metal matrix composite of claim 1, wherein a strength of the primary metal particles is greater than a strength of the metal carbide particles and a strength of the fused carbide particles, and the strength of the metal carbide particles is greater than the strength of the fused carbide particles.

21. The metal matrix composite of claim 1, wherein a thermal conductivity of the primary metal particles is greater than a thermal conductivity of the metal carbide particles and a thermal conductivity of the fused carbide particles, and the thermal conductivity of the metal carbide particles is greater than the thermal conductivity of the fused carbide particles.

22. The metal matrix composite of claim 1, wherein a hardness of the fused carbide particles is greater than a hardness of the metal carbide particles and a hardness of the primary metal particles, and the hardness of the metal carbide particles is greater than the hardness of the primary metal particles.

23. The metal matrix composite of claim 1, wherein an erosion resistance of the fused carbide particles is greater than an erosion resistance of the tungsten metal particles and an erosion resistance of the metal carbide particles.

24. The metal matrix composite of claim 1, wherein:

the metal carbide particles have an average particle size of 0.5 microns to 74 microns; and the fused carbide particles have an average particle size of 75 microns to 400 microns.

25. A metal matrix composite for use in a drill bit, the metal matrix composite comprising:

(a) a metal matrix composite particle mixture comprising:

(i) primary metal particles comprising tungsten, wherein the primary metal particles are present in an amount of 30 weight percent to 50 weight percent, and wherein the primary metal particles have an average particle size of less than 20 microns;

(ii) metal carbide particles in an amount of 30 weight percent to 50 weight percent, wherein the metal carbide particles have an average particle size of 20 microns to 45 microns;

(iii) substantially spherical fused carbide particles in an amount of 10 weight percent to 20 weight percent, wherein the substantially spherical fused carbide particles have an average particle size of 150 microns to 400 microns; and (iv) secondary metal particles comprising nickel in an amount of 2 weight percent to 8 weight percent, wherein the secondary metal particles have an average particle size of 3 microns to 7 microns; and (b) a metal binder;

wherein the metal matrix composite has an erosion resistance of no more than 12 $mm^3/kg$ and a transverse rupture strength of at least 1150 MPa.

* * * * *